US007428458B2

(12) United States Patent
Ishikawa et al.

(10) Patent No.: US 7,428,458 B2
(45) Date of Patent: Sep. 23, 2008

(54) CONTROL APPARATUS FOR INTERNAL COMBUSTION ENGINE

(75) Inventors: Osamu Ishikawa, Chiyoda-ku (JP); Keiichi Enoki, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/785,121

(22) Filed: Apr. 16, 2007

(65) Prior Publication Data

US 2007/0277789 A1 Dec. 6, 2007

(30) Foreign Application Priority Data

Jun. 5, 2006 (JP) ..... 2006-156091

(51) Int. Cl.
*F02D 41/00* (2006.01)
*F02M 25/08* (2006.01)

(52) U.S. Cl. ..... 701/104; 123/520

(58) Field of Classification Search ..... 701/105, 701/102, 103, 104, 115; 123/516, 520
See application file for complete search history.

(56) References Cited

U.S. PATENT DOCUMENTS 5,626,122 A * 5/1997 Azuma ..... 123/698
6,880,541 B2 * 4/2005 Hanazaki et al. ..... 123/520
7,171,960 B1 * 2/2007 Hagari ..... 123/520

FOREIGN PATENT DOCUMENTS

JP 8-261038 A 10/1996
JP 2005-98137 A * 4/2005
JP 2006-125304 5/2006

* cited by examiner

*Primary Examiner*—Hieu T Vo
(74) *Attorney, Agent, or Firm*—Sughrue Mion, PLLC

(57) ABSTRACT

A control apparatus for an internal combustion engine, where a calculated fuel injection quantity is corrected with a purge-air-concentration learnt value calculated by subjecting a purge air concentration to purge-air-concentration filtering. A filtering effect in the purge-air-concentration filtering is changed in the direction of enhancing exhaust gas purification, when the purge air concentration is thick and when the purge air concentration is thin, whereby an air/fuel ratio introduced into the internal combustion engine is precisely controlled to a target air/fuel ratio so as to enhance the exhaust gas purification.

6 Claims, 8 Drawing Sheets

Prior Art

CONTROL APPARATUS FOR INTERNAL COMBUSTION ENGINE

BACKGROUND OF THE INVENTION

1. Field of the Invention

This invention relates to a control apparatus for an internal combustion engine, wherein a fuel injection quantity calculated by fuel-injection-quantity calculation means is corrected with purge-air-concentration learnt value which has been calculated by subjecting a purge air concentration to purge-air-concentration filtering, and wherein fuel in the corrected fuel injection quantity is injected from an injector.

2. Description of the Related Art

There has heretofore been known a vaporized-fuel processing device wherein vaporized fuel produced within the fuel feed system of an internal combustion engine, e. g., within a fuel tank is adsorbed and stored in a vaporized-fuel adsorption device (hereinbelow, termed the "canister") and is thereafter introduced into the suction system of the engine together with air, thereby to purify (hereinbelow, expressed as "purge") the canister.

Such a vaporized-fuel processing device has been as stated below. A purge valve is driven so as to realize a target purge air quantity which is set in accordance with the running state of the engine. When the vaporized fuel adsorbed in the canister has been introduced into the suction system together with the air, a deviation develops between an air/fuel ratio being a control target and an actual air/fuel ratio in accordance with the concentration of the vaporized fuel in the purge air. Therefore, a fuel injection quantity is corrected by an air/fuel ratio feedback control so as to bring the actual air/fuel ratio near to the air/fuel ratio being the control target. On this occasion, the purge air concentration is calculated from an actual purge rate and the correction magnitude of the air/fuel ratio feedback control, a purge-air-concentration learnt value is calculated by subjecting the calculated purge air concentration to filtering, and the fuel injection quantity is further corrected in accordance with the actual purge rate and the purge-air-concentration learnt value.

Besides, JP-A-8-261038 discloses a technique wherein the purge air concentration calculated from the purge rate and the air/fuel-ratio-feedback correction coefficient is subjected to the filtering, thereby to calculate the purge-air-concentration learnt value, and wherein when the purge air concentration has been calculated for the first time after the start of the internal combustion engine, the calculated result is not subjected to the filtering, but it is directly set as the purge-air-concentration learnt value, whereby the purge air concentration is calculated accurately and promptly.

Such prior-art vaporized-fuel processing devices for the engine, however, have had problems as stated below. First, as the actual behavior of the purge air concentration, after the start, the purge introduction is done in the state of a thick purge air concentration because the vaporized fuel in a large quantity is held adsorbed in the canister. As the purge introduction proceeds in accordance with the running state, the purge air concentration changes in the direction of thinning from the thick state, while fluctuating in accordance with a purge flow rate. (Refer to (a) in FIG. 9.) When the purge introduction has proceeded to some extent, to decrease the vaporized fuel adsorbed in the canister, the purge air concentration becomes thin. Therefore, the changes of the purge flow rate do not conspicuously appear in the purge air concentration changes, and the purge air concentration changes gently. Besides, in the case where the purge air concentration is thin, the calculation of the purge air concentration is more susceptible to disturbances (such as air/fuel ratio fluctuations ascribable to an acceleration and a deceleration) other than the purge, and the errors of the purge-air-concentration calculation become large. (Refer to (b) in FIG. 9.)

Meanwhile, with the prior art stated in JP-A-8-261038, in the case where the purge air concentration has been calculated for the first time after the start of the internal combustion engine, without considering the changing situation of the purge air concentration, the calculated result is not subjected to the filtering and is directly set as the purge-air-concentration learnt value. Thereafter, the purge air concentration is subjected to the filtering with a predetermined fixed filter constant, thereby to calculate the purge-air-concentration learnt value.

Here, in filtering the calculated result of the purge air concentration and calculating the purge-air-concentration learnt value, the filter constant which can absorb the purge-air-concentration calculation errors ((c) in FIG. 9) having developed in the case where the purge air concentration is thin and changes gently is set by way of example. Then, the purge-air-concentration fluctuations ((d) in FIG. 9) ascribable to the purge-flow-rate changes are also absorbed, and an accurate purge-air-concentration learnt value cannot be calculated ((e) in FIG. 9). Therefore, the air/fuel ratio cannot be maintained at the target air/fuel ratio (for example, a theoretical air/fuel ratio), resulting in the problem that an exhaust gas worsens.

SUMMARY OF THE INVENTION

This invention has been made in view of the circumstances as stated above, and it has for its object to control an air/fuel ratio which is introduced into an internal combustion engine, precisely to a target air/fuel ratio, and to achieve enhancement in exhaust gas purification.

A control apparatus for an internal combustion engine according to this invention consists, in a control apparatus for an internal combustion engine wherein a fuel injection quantity calculated by fuel-injection-quantity calculation means is corrected with a purge-air-concentration learnt value which has been calculated by subjecting a purge air concentration to purge-air-concentration filtering and wherein fuel in the corrected fuel injection quantity is injected from an injector, in that a filtering effect in the purge-air-concentration filtering is changed in the direction of enhancing exhaust gas purification, between in a case where the purge air concentration is thick and in a case where it is thin. Thus, in the control apparatus for the internal combustion engine wherein the fuel injection quantity calculated by the fuel-injection-quantity calculation means is corrected with the purge-air-concentration learnt value which has been calculated by subjecting the purge air concentration to the purge-air-concentration filtering and wherein the fuel in the corrected fuel injection quantity is injected from the injector, even when the purge air concentration has changed depending upon the running state of the engine, an appropriate air/fuel ratio is established to enhance the exhaust gas purification.

The foregoing and other objects, features, aspects and advantages of the present invention will become more apparent from the following detailed description of the present invention when taken in conjunction with the accompanying drawings.

DETAILED DESCRIPTION OF THE INVENTION

Embodiment

Now, an embodiment of this invention will be described in conjunction with FIGS. 1-8.

Figure 1:
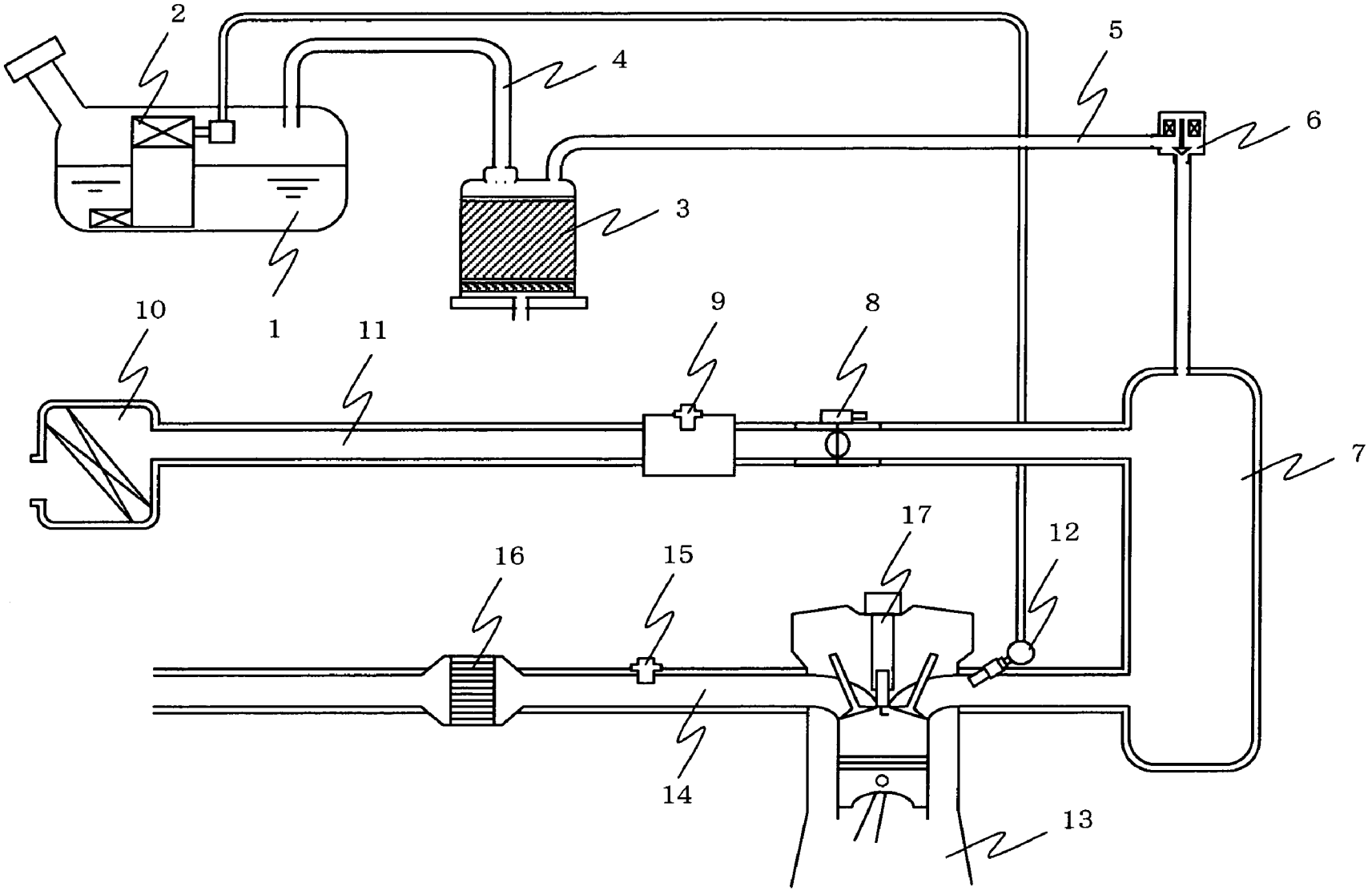
FIG. 1 is a schematic view showing an example of a configuration in an embodiment of this invention.

Schematically shown in FIG. 1 is an example of a control apparatus for an internal combustion engine including a vaporized-fuel processing device. Referring to FIG. 1, an airflow sensor 9 which detects a suction air quantity imbibed through an air cleaner 10, and a throttle valve 8 which controls the suction air quantity are disposed in the suction passage 11 of the internal combustion engine 13. The suction passage 11 is connected to a surge tank 7.

An injector 12 is disposed in a suction manifold section in the downstream of the surge tank 7, and fuel pumped out by a fuel pump 2 within a fuel tank 1 is injected by the injector 12, whereby the internal combustion engine 13 is fed with the fuel. By the way, in case of an internal combustion engine of in-cylinder injection type not shown, an injector is disposed toward the interior of the combustion chamber of the internal combustion engine.

In the exhaust passage 14 of the internal combustion engine 13, an air/fuel ratio sensor 15 which detects the air/fuel ratio of an exhaust gas is disposed near the aggregate portion of an exhaust manifold section, and a ternary catalyst 16 being an exhaust purification catalyst which purifies the exhaust gas by oxidizing CO and HC and deoxidizing $NO_x$ in the exhaust gas, at a predetermined air/fuel ratio (for example, a theoretical air/fuel ratio) is disposed in the downstream of the air/fuel ratio sensor 15.

Further, the internal combustion engine 13 is provided with the vaporized-fuel processing device by which the fuel vaporized within the fuel tank 1 is prevented from escaping into the atmospheric air.

The vaporized-fuel processing device includes a canister 3 which has an active carbon layer for adsorbing the fuel vaporized from the fuel tank 1. An atmosphere opening port is provided on one side of the active carbon layer within the canister 3, while a vaporized-fuel passage 4 which joins the fuel tank 1 and the canister 3, and a purge passage 5 which joins the canister 3 and the surge tank 7 are connected to the other side.

Further, a purge control solenoid valve (hereinbelow, written as the "purge valve") 6 which is purge-air-quantity control means for controlling the flow rate of purge air is disposed in the purge passage 5.

A control unit, not shown, which controls these constituents is configured of a digital computer and an I/F circuit. The digital computer includes a RAM, a ROM, a CPU, input ports, and output ports which are interconnected through a bi-directional bus. This digital computer has the function of manipulating the output ports on the basis of information obtained from the input ports, in such a way that the CPU runs control programs for the internal combustion engine as are stored in the ROM, by the use of the RAM. Further, the input ports and the output ports are connected through the I/F circuit to sensors for detecting the running state of the internal combustion engine and actuators for controlling the running state of the internal combustion engine as are disposed outside the control unit.

As a practicable control method for the internal combustion engine, running-state detection means such as a sensor for sensing the rotation of the internal combustion engine, an atmospheric pressure sensor, a suction temperature sensor, a water temperature sensor, a throttle opening-degree sensor, and a knock sensor, not shown, and the airflow sensor 9 and the air/fuel ratio sensor 15 are connected to the input ports. A fuel quantity to be injected by the injector 12 is calculated on the basis of an environmental state around the internal combustion engine, and the running state of the internal combustion engine, especially the revolutions per minute and the suction air quantity of the internal combustion engine as are obtained by the running-state detection means. Further, a timing at which a mixture within a combustion chamber is ignited by an ignition coil 17 and an ignition plug is calculated, and the injector 12 and the ignition coil 17 connected to the output ports are controlled on the basis of the calculated result.

In the calculation of the fuel quantity, a basic fuel quantity which achieves the theoretical air/fuel ratio is calculated for a suction-air-quantity equivalent value imbibed during one stroke (for example, a charging efficiency), and the basic fuel quantity is subjected to corrections such as an air/fuel ratio correction, a warming-up correction, and in-start and post-start corrections, thereby to calculate the final fuel quantity. Further, an air/fuel ratio feedback control is performed for correcting the basic fuel quantity so as to achieve the target air/fuel ratio in accordance with the air/fuel ratio detected by the air/fuel ratio sensor 15.

A control method for the vaporized-fuel processing device is as stated below.

Irrespective of whether the internal combustion engine is running or is at a stop, the vaporized fuel produced in the fuel tank 1 is once adsorbed and stored in the active carbon layer within the canister 3. Since the adsorbability of the active carbon layer is finite, the vaporized fuel adsorbed and stored in the active carbon layer needs to be purified (hereinbelow, expressed as "purged").

As a purge method for the canister 3, it is common to utilize a negative pressure which is generated within the surge tank 7 during the running of the internal combustion engine 13. When the purge valve 6 is opened during the running of the internal combustion engine 13, a stream which proceeds from the atmosphere opening port of the canister 3 toward the surge tank 7 is generated in the purge passage 5 by the negative pressure within the surge tank 7. As a result, air (hereinbelow, termed the "purge air"), which contains the vaporized fuel released from active carbon when the air introduced from the atmosphere opening port of the canister 3 passes through the active carbon layer, is introduced into the surge tank 7.

Incidentally, the flow rate of the purge air on this occasion is controlled by the purge valve 6.

Thereafter, the purge air mixes with the suction air within the surge tank 7 and is introduced into the combustion chamber of the internal combustion engine 13, and the mixture is combusted together with the fuel injected from the injector 12, whereby the vaporized fuel produced in the fuel tank 1 is finally processed. As a result, the vaporized fuel produced in the fuel tank 1 is not emitted into the atmosphere.

Figure 2:
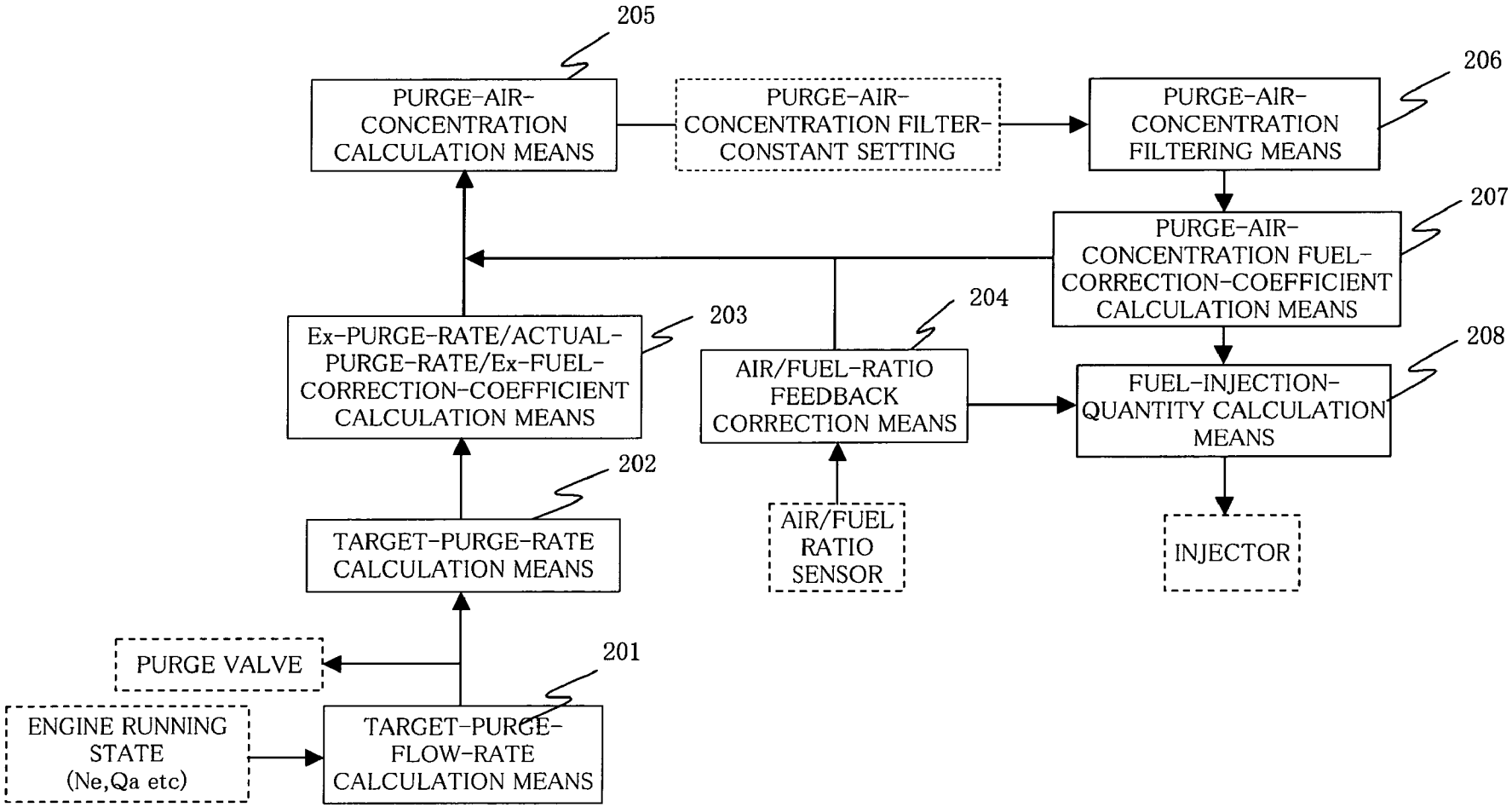
FIG. 2 is a block diagram showing examples of control blocks in the embodiment of this invention.

In FIG. 2, the outline of the embodiment of this invention is shown as a control block diagram.

Here, the embodiment will be described in more detail with reference to FIG. 2.

In target-purge-flow-rate calculation means 201, the running state of the engine is detected on the basis of information obtained by the sensors, and a target purge flow rate which is determined by the running state is set. The purge valve is driven so as to realize the target purge flow rate.

In target-purge-rate calculation means 202, a target purge rate is calculated from the target purge flow rate.

In Ex-purge-rate/actual-purge-rate/Ex-fuel-correction-coefficient calculation means 203, an actual purge rate which is a purge rate within the combustion chamber, an Ex purge rate which is a purge rate corresponding to the vicinity of the air/fuel ratio sensor, and an Ex fuel correction coefficient are calculated in consideration of the transport delays of the purge air, the suction air and the fuel.

Incidentally, "Ex" in the Ex purge rate and the Ex fuel correction coefficient, usually signifies an exhaust system or an exhaust side. Also in this embodiment, "Ex" is used in the same significance or the significance of "corresponding to the vicinity of the air/fuel ratio sensor", or it signifies a value in which the exhaust system (Ex) delay involved since the introduction of the purge till the detection of the air/fuel ratio by the air/fuel ratio detection means is considered (corrected).

In air/fuel-ratio feedback correction means 204 which is also air/fuel-ratio control means, the air/fuel-ratio feedback correction coefficient is calculated for correcting the fuel injection quantity on the basis of the detection output of the air/fuel ratio sensor so as to establish the target air/fuel ratio.

In purge-air-concentration calculation means 205, a purge air concentration is calculated on the basis of the Ex purge rate, the air/fuel-ratio feedback correction coefficient and the Ex fuel correction coefficient.

In purge-air-concentration filtering means 206 which is purge-air-concentration learnt-value calculation means, the purge air concentration is subjected to purge-air-concentration filtering, thereby to calculate a purge-air-concentration learnt value.

As a filter constant for use in the purge-air-concentration filtering, separate values are respectively set for a case where a purge-air integrated magnitude since the start of the purge-air-concentration learning till the completion thereof is less than a predetermined value, and for a case where the purge-air integrated magnitude after the completion of the purge-air-concentration learning is not less than the predetermined value.

A method for the purge-air-concentration filtering will be explained later.

In purge-air-concentration fuel-correction-coefficient calculation means 207, when the calculation of the purge-air-concentration learnt value has been completed, a purge-air-concentration fuel correction coefficient is calculated on the basis of the actual purge rate and the purge-air-concentration learnt value. Besides, when the calculation of the purge-air-concentration learnt value has not been completed yet, the purge-air-concentration fuel correction coefficient is held unchanged at an initial value, and the correction of the fuel is not made. In fuel-injection-quantity calculation means 208, the fuel injection quantity is calculated on the basis of the air/fuel-ratio feedback correction coefficient and the purge-air-concentration fuel correction coefficient.

Meanwhile, during the closure of the purge valve, the output of the air/fuel ratio sensor ought to be in substantial agreement with the target air/fuel ratio, in the case where the air/fuel ratio feedback control is being performed so as to realize the target air/fuel ratio.

The integral term of the air/fuel ratio feedback correction coefficient on this occasion sometimes deviates from a median on account of the dispersions of the airflow sensor and the injector.

It is common practice to store the deviation magnitude as an air/fuel-ratio learnt value. When such air/fuel ratio learning is executed, the air/fuel ratio feedback control proceeds so that the integral term of the air/fuel ratio feedback correction coefficient may become the median.

Next, the introduction of the purge will be considered.

When the purge air whose air/fuel ratio is unknown is introduced while the injector is being controlled on the basis of the detection result of the airflow sensor and the air/fuel ratio sensor, the output of the air/fuel ratio sensor oscillates onto a lean side or a rich side except in a case where the target air/fuel ratio and the air/fuel ratio of the purge air are in agreement.

Physical phenomena which take place here will be put in order. It is obvious that the oscillation magnitude of the air/fuel ratio sensor depends upon a suction-air flow rate, a purge air quantity and a fuel quantity in the vicinity of the air/fuel ratio sensor, and the air/fuel ratio in the purge air (hereinbelow, termed the "purge air concentration").

It is accordingly understood that the purge air concentration being an unknown value can be calculated from the suction-air flow rate, purge air quantity and fuel quantity in the vicinity of the air/fuel ratio sensor as have thus far been calculated, and the detection value of the air/fuel ratio sensor or the deviation magnitude of the integral term of the air/fuel ratio feedback correction coefficient from the median.

The purge air concentration calculated in this way is subjected to the purge-air-concentration filtering stated above, thereby to calculate the purge-air-concentration learnt value.

In the case where the purge air concentration has been calculated in this way, there develop errors ascribable to the dispersions of the airflow sensor, injector and air/fuel ratio sensor and the cycle of the air/fuel ratio feedback control, and purge-air-concentration calculation errors ascribable to disturbances other than the purge air (such as air/fuel ratio fluctuations ascribable to an acceleration and a deceleration). In order to absorb the errors, the purge air concentration calculated every stroke is subjected to the filtering and is smoothed, thereby to calculate the purge-air-concentration learnt value.

Next, in a case where the purge-air-concentration learnt value is being calculated and where the purge air fed from the purge valve is flowing into the combustion chamber, the fuel quantity can be corrected so that a deviation may not be incurred in the detection air/fuel ratio of the air/fuel ratio sensor by the purge air.

More specifically, the purge-air-concentration fuel correction coefficient is calculated from the purge-air-concentration learnt value, a suction air quantity after a suction delay model process to be explained later, and the purge air quantity, and the fuel quantity to be fed from the injector is calculated by the fuel-injection-quantity calculation means in accordance with the air/fuel ratio feedback coefficient and the purge-air-concentration fuel correction coefficient. Thus, even in a case where the introduction quantity of the purge air and the suction air quantity have changed with the air/fuel ratio feedback correction coefficient controlled to the median, the purge-air-concentration fuel correction coefficient is appropriately calculated, and also the air/fuel ratio is controlled to the target value.

Now, a more detailed control method will be described with reference to flow charts shown in FIGS. 3 through 7.

Figure 3:
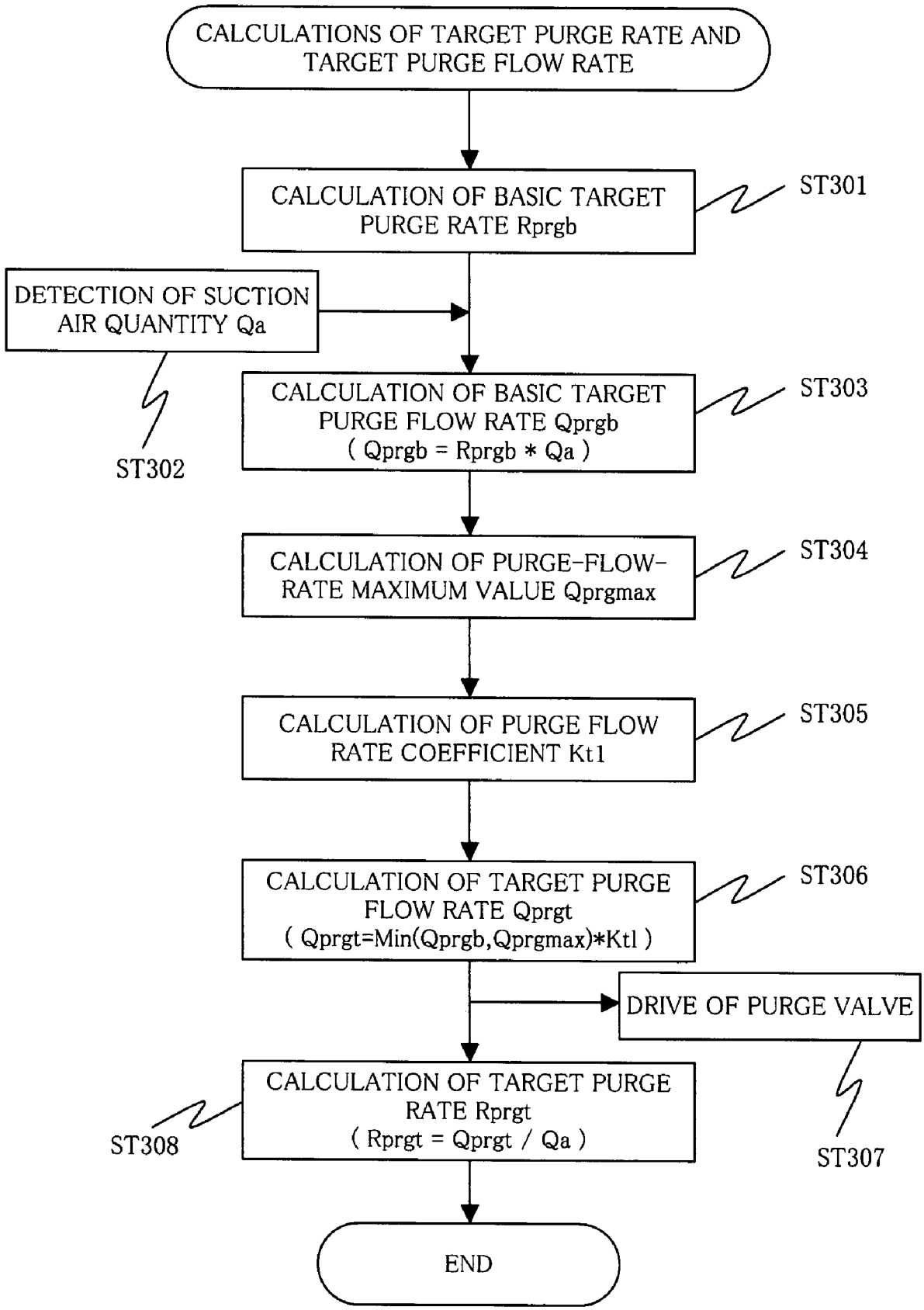
FIG. 3 is a flow chart showing calculated examples of a target purge rate and a target purge flow rate in the embodiment of this invention.

FIG. 3 shows the subroutine of the operations of calculating the target purge rate and the target purge flow rate in the target-purge-rate calculation means 202 and the target-purge-flow-rate calculation means 201 in FIG. 2, respectively.

Referring to FIG. 3, at a step ST301, a basic target purge rate Rprgb is calculated as the basic value of the target purge rate.

A more practicable calculation method is a method in which the basic target purge rates Rprgb corresponding to the running states which are detected by the running-state detection means, for example, the individual conditions of an idling mode, a non-idling mode, an acceleration or deceleration mode, and a high load running mode are stored in the ROM of the digital computer beforehand, and in which any of the basic target purge rates Rprgb is read out in accordance with the detected running state.

Another method is such that a table (hereinbelow, termed the "control map") in which axes represent parameters indicating the running state, for example, the revolutions-per-minute of the internal combustion engine and the charging efficiency thereof or a pressure within the surge tank is prepared, whereupon the basic target purge rates Rprgb are stored in the control map beforehand, and that any of the basic target purge rates Rprgb is read out in accordance with the detected running state.

A step ST302 indicates that a suction air quantity Qa detected by a subroutine for detecting the running state of the internal combustion engine is employed at a step ST303.

The step ST303 indicates that a basic target purge flow rate Qprgb is calculated from the basic target purge rate Rprgb and the suction air quantity Qa.

Meanwhile, an example of a general purge valve is a valve capable of changing the purge flow rate on the basis of a so-called "DUTY control" in which a stream generated by the pressure difference between the pressure of the atmosphere opening port of the canister 3, that is, the atmospheric pressure and a negative pressure developing within the surge tank 7 is utilized for turning ON/OFF the solenoid valve portion of the purge valve, so as to control the ratio of the turn-ON/OFF. With the purge valve of this type, the maximum value of the flow rate is attained in a case where the ON state of the purge valve continues, that is, where a DUTY is 100%. It is known that the flow-rate maximum value changes depending upon the pressure difference between the atmospheric pressure and the negative pressure of the surge tank. It is theoretically impossible to achieve a flow rate larger than the maximum value.

At a step ST304, therefore, a purge-flow-rate maximum value Qprgmax is calculated. A method for the calculation may be such that the purge-flow-rate maximum values of the purge valve to be handled are previously stored in a control map whose axes represent the maximum value and the pressure difference between the atmospheric pressure and the surge-tank negative pressure, and that any of the purge-flow-rate maximum values is read out in accordance with an environmental condition and the running state.

At a step ST305, a purge flow rate coefficient KT1 is calculated.

The "purge flow rate coefficient KT1" is a coefficient which serves to prevent a drive feeling from worsening due to the sudden change of the purge flow rate.

Besides, until the purge-air-concentration learning is completed, the purge air concentration is unknown, and hence, the exhaust gas might worsen on account of the introduction of a large quantity of purge air. Therefore, the purge air needs to be held in a comparatively small quantity, and the purge flow rate coefficient KT1 is also a coefficient for limiting the purge flow rate for this purpose.

An example of a calculation method for the purge flow rate coefficient KT1 will be explained below.

By way of example, when the purge flow rate coefficient KT1 is 0 (zero), the purge control shall be stopped, whereas when the coefficient KT1 is 1 (one), the purge flow rate shall be controlled with the basic target purge flow rate Qprgb. Thus, the purge flow rate coefficient KT1 is defined as a coefficient which moves between 0 and 1.

The purge flow rate coefficient KT1 demonstrates such a movement that, when the introduction of the purge air is allowed, a predetermined value is added every predetermined time period, and that, when the introduction of the purge air is inhibited, the predetermined value is subtracted every predetermined time period.

Besides, until the purge-air-concentration learning is completed, an upper limit value is set for the purge flow rate coefficient KT1, and the coefficient KT1 is clipped to the upper limit value, whereby the purge flow rate can be limited.

At a step ST306, it is indicated that the final target purge flow rate Qprgt is calculated from the basic target purge flow rate Qprgb, purge-flow-rate maximum value Qprgmax and purge flow rate coefficient KT1.

At a step ST307, it is indicated that the purge valve is driven by another subroutine. On this occasion, the purge valve is controlled so as to achieve the target purge flow rate Qprgt. A method for the control may be such that, when the purge valve is, for example, of the aforementioned type wherein the flow rate is controlled by the DUTY control, DUTY ratios at which the target purge flow rates Qprgt are achieved are previously stored in a control map whose axes represent the flow rate of the purge valve and the pressure difference between the atmospheric pressure and the surge-tank negative pressure, whereupon any of the target purge flow rates Qprgt is read out in accordance with the environmental condition and the running state.

In addition, at a step ST308, it is indicated that the purge rate which is finally achieved is calculated as the target purge rate Rprgt.

In this way, the target purge rate and the target purge flow rate are calculated.

Figure 4:
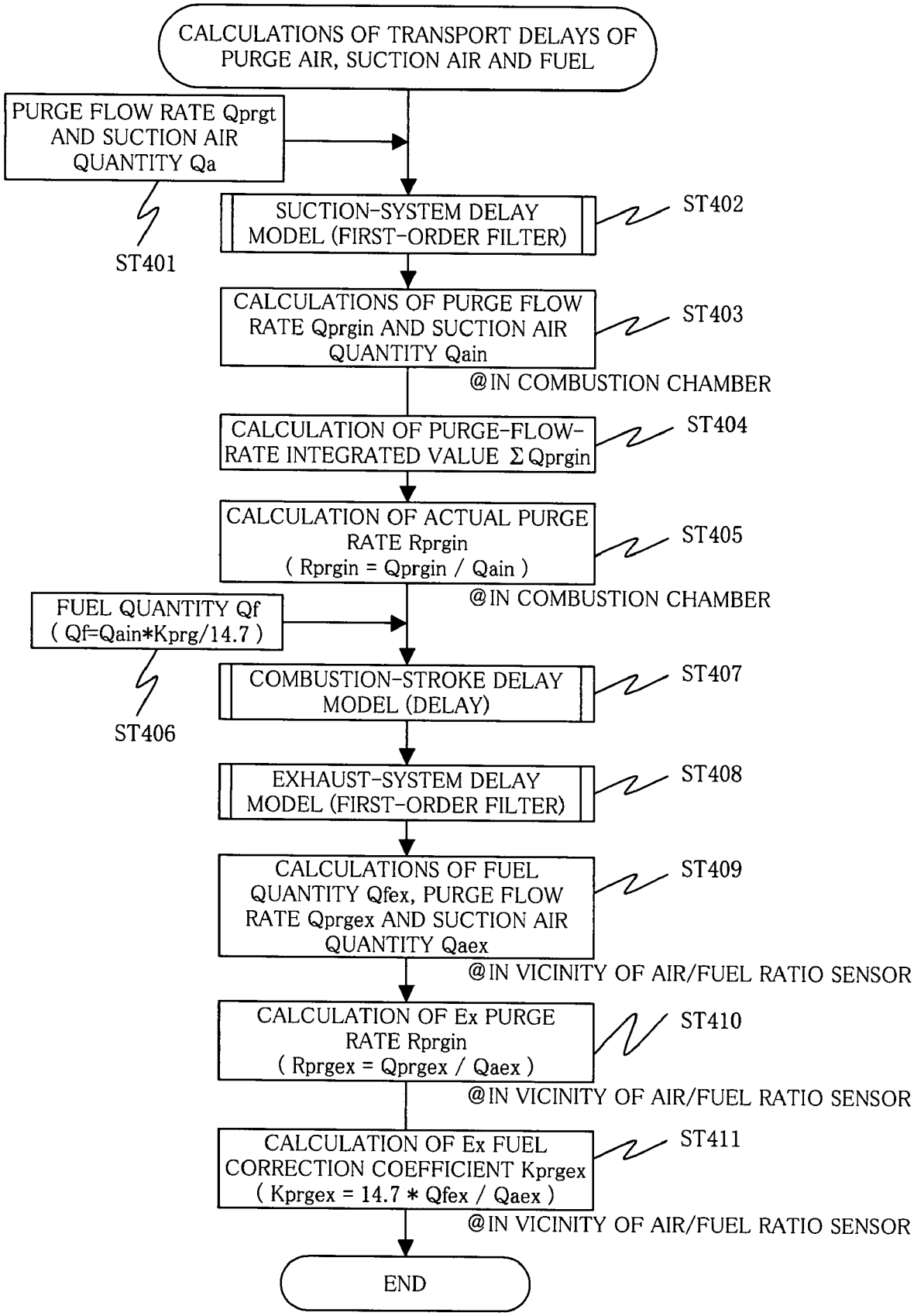
FIG. 4 is a flow chart showing calculated examples of the transport delays of purge air, suction air, and fuel in the embodiment of this invention.

FIG. 4 shows the subroutine of the operations of calculating the transport delays of the purge air, suction air and fuel in the Ex-purge-rate/actual-purge-rate/Ex-fuel-correction-coefficient calculation means 203 in FIG. 2.

Referring to FIG. 4, a step ST401 indicates that the target purge flow rate Qprgt which has been calculated in the aforementioned subroutine for calculating the target purge rate and the target purge flow rate and which has been reread as the actual purge flow rate, and the suction air quantity Qa which has been detected in the subroutine for detecting the running state of the internal combustion engine, are employed at a step ST402.

At the step ST402, a first-order lag element is handled as a suction-system delay model, and concretely a first-order filter is employed, thereby to simulate the response delay of the suction system of the internal combustion engine.

The application of the first-order filter to the digital computer can be generally realized by employing a digital first-order filter based on the following formulas:

$$Qain(n)=K*Qain(n-1)+(1-K)*Qa(n)$$

$$Qprgin(n)=K*Qprgin(n-1)+(1-K)*Qprgt(n)$$

Here,

Qa(n) denotes a suction air quantity which the airflow sensor has detected during the nth stroke;

Qain(n) denotes a suction air quantity which is introduced into the combustion chamber of the internal combustion engine during the nth stroke;

Qain(n−1) denotes a suction air quantity which has been introduced into the combustion chamber of the internal combustion engine during the (n−1)th stroke; and K denotes a filter constant, which usually has a value of about 0.9.

Qprgt(n) denotes a purge air quantity which has been introduced from the purge valve during the nth stroke;

Qprgin(n) denotes a purge air quantity which is introduced into the combustion chamber of the internal combustion engine during the nth stroke; and Qprgin(n−1) denotes a purge air quantity which has been introduced into the combustion chamber of the internal combustion engine during the (n−1)th stroke.

Further, the calculations are executed every stroke of the internal combustion engine.

As the calculation results of the step ST402, an actual purge flow rate Qprgin and a suction air quantity Qain in the combustion chamber of the internal combustion engine are calculated at a step ST403.

At a step ST404, the actual purge flow rates Qprgin are integrated at the respective strokes with an initial value at the start set at 0 (zero), whereby a purge-flow-rate integrated value ΣQprgin is calculated.

At a step ST405, an actual purge rate Rprgr which is a purge rate in the combustion chamber is calculated using the actual purge flow rate Qprgin and the suction air quantity Qain.

Subsequently, a step ST406 indicates that a fuel quantity Qf calculated by another subroutine is employed at a step ST407.

The fuel quantity Qf is generally calculated with the suction air quantity Qain in the combustion chamber, the target air/fuel ratio (14.7 if it is the theoretical air/fuel ratio), and the correction coefficients as stated before.

"Kprg" in the calculation formula indicated at the step ST406 is a purge-air-concentration fuel correction coefficient to be explained later, and other correction values of, for example, an air/fuel ratio correction, a warming-up correction, in-start and post-start corrections, and an air/fuel-ratio feedback correction are not written in the formula.

At the step ST407, it is indicated that the purge flow rate Qprgin and suction air quantity Qain in the combustion chamber, and the fuel quantity Qf are subjected to delay processing based on a combustion-stroke delay model. A delay time period is usually a time period equivalent to 4 strokes, in case of a 4-stroke engine.

Subsequently, at a step ST408, as in the suction-system delay model, a first-order lag element is handled as an exhaust-system delay model, and concretely a first-order filter is employed, thereby to simulate the response delay of the exhaust system of the internal combustion engine.

The application of the first-order filter to the digital computer can be generally realized by employing a digital first-order filter based on the following formulas:

$$Qaex(n)=K*Qaex(n-1)+(1-K)*Qain(n-4)$$

$$Qprgex(n)=K*Qprgex(n-1)+(1-K)*Qprgin(n-4)$$

$$Qfex(n)=K*Qfex(n-1)+(1-K)*Qfin(n-4)$$

Here,

Qaex(n) denotes a suction air flow rate which reaches the vicinity of the air/fuel ratio sensor and is detected by the air/fuel ratio sensor during the nth stroke;

Qaex(n−1) denotes a suction air flow rate which has reached the vicinity of the air/fuel ratio sensor and has been detected by the air/fuel ratio sensor during the (n−1)th stroke;

Qain(n−4) denotes a suction air quantity which has been introduced into the combustion chamber of the internal combustion engine during the (n−4)th stroke; and K denotes a filter constant, which usually has a value of about 0.9.

Further, when the calculations are executed every stroke of the internal combustion engine, the combustion stroke delay of the step ST407 can also be calculated by the calculation formula because of the employment of Qain(n−4).

Further,

Qprgex(n) denotes a purge air quantity which reaches the vicinity of the air/fuel ratio sensor and is detected by the air/fuel ratio sensor during the nth stroke;

Qprgex(n−1) denotes a purge air quantity which has reached the vicinity of the air/fuel ratio sensor and has been detected by the air/fuel ratio sensor during the (n−1)th stroke;

Qprgin(n−4) denotes a purge air quantity which has been introduced into the combustion chamber of the internal combustion engine during the (n−4) th stroke;

Qfex(n) denotes a fuel quantity which reaches the vicinity of the air/fuel ratio sensor and is detected by the air/fuel ratio sensor during the nth stroke;

Qfex(n−1) denotes a fuel quantity which has reached the vicinity of the air/fuel ratio sensor and has been detected by the air/fuel ratio sensor during the (n−1)th stroke; and Qfin(n−4) denotes a fuel quantity which has been introduced into the combustion chamber of the internal combustion engine during the (n−4) th stroke.

As the calculation results of the steps ST407 and ST408, the purge flow rate Qpregex, suction air quantity Qaex and fuel quantity Qfex which correspond to the vicinity of the air/fuel ratio sensor are calculated at a step ST409. Using these calculated results, an Ex purge rate Rprgex which is the purge rate corresponding to the vicinity of the air/fuel ratio sensor is calculated at a step ST410, and an Ex fuel correction coefficient Kprgex is calculated at a step ST411. This coefficient is a value corresponding to the vicinity of the air/fuel ratio sensor, of the purge-air-concentration fuel coefficient Kprg in the calculation formula indicated at the step ST406.

Figure 5:
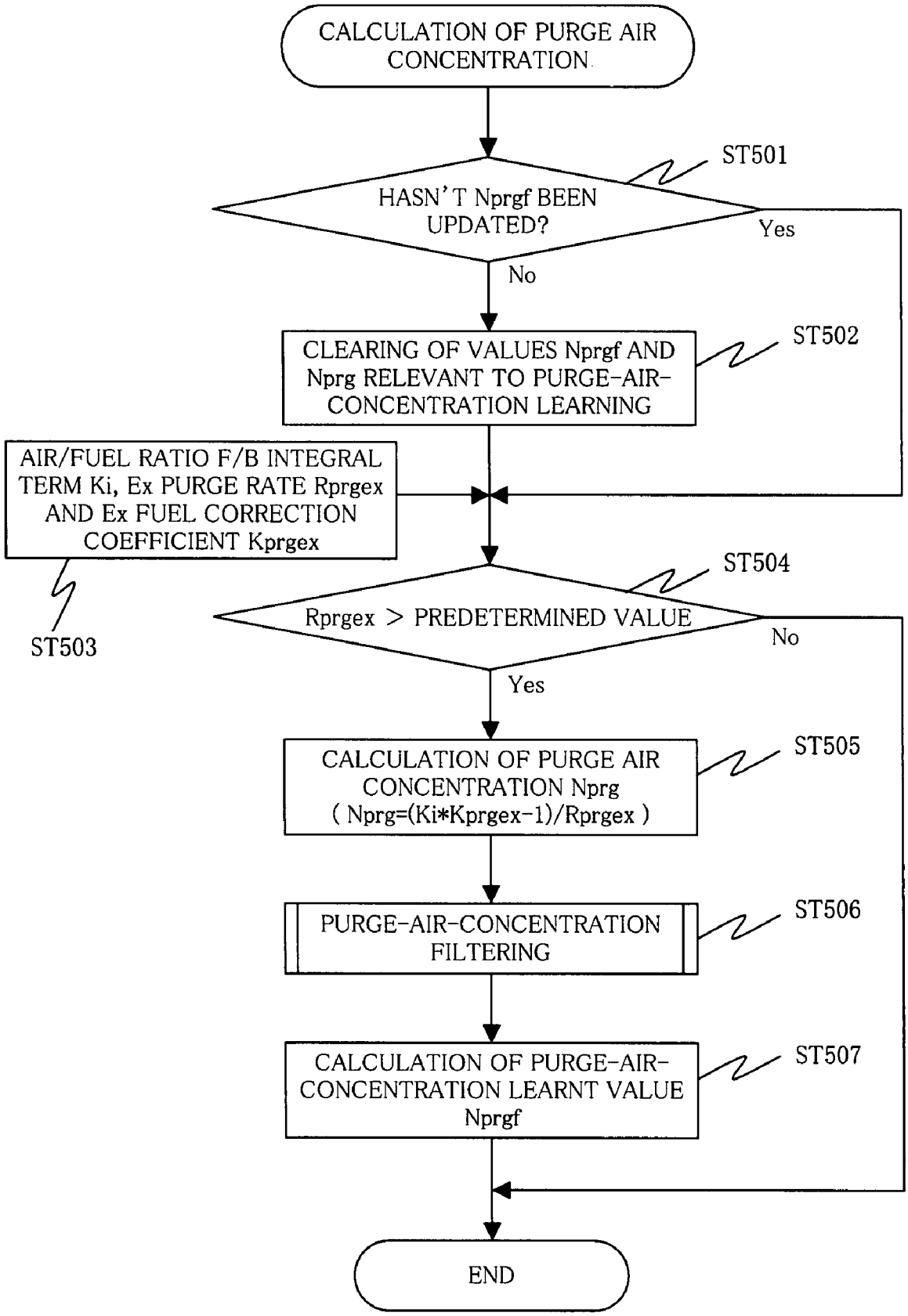
FIG. 5 is a flow chart showing a calculated example of a purge air concentration in the embodiment of this invention.

FIG. 5 shows the subroutine of the operation of calculating the purge air concentration in the purge-air-concentration calculation means 205 in FIG. 2.

Referring to FIG. 5, at a step ST501, whether or not a purge-air-concentration learnt value Nprgf has been updated within a predetermined period is judged. Here, in a case where the purge-air-concentration learnt value Nprgf has been updated within the predetermined period, this subroutine proceeds to a step ST504, and in a case where the learnt value Nprgf has not been updated, this subroutine proceeds to a step ST502, at which values relevant to purge-air-concentration learning are cleared.

A step ST503 indicates that the air/fuel-ratio feedback-correction-coefficient integral term Ki, Ex purge rate Rprgex and Ex fuel correction coefficient Kprgex which have been calculated by the other subroutines are employed at the step ST504 and a step ST505.

At the step ST504, whether or not the Ex purge rate Rprgex is greater than a predetermined value is judged. Here, in a case where the Ex purge rate Rprgex is greater than the predetermined value, this routine proceeds to the step ST505, and in a case where it is not greater, this subroutine is ended.

At the step ST505, the purge air concentration Nprg is calculated. The purge air concentration Nprg calculated here is a value which ought to be termed the "instantaneous value". In order to absorb errors ascribable to the dispersions of the airflow sensor, injector and air/fuel ratio sensor and to an air/fuel ratio feedback control cycle, and purge-air-concentration calculation errors ascribable to disturbances other than the purge air (such as air/fuel ratio fluctuations ascribable to an acceleration and a deceleration), the purge air concentration calculated every stroke is subjected to filtering to be explained later, at a step ST506, until the purge-air-concentration learnt value Nprgf indicated at a step ST507 is finally calculated.

Figure 6:
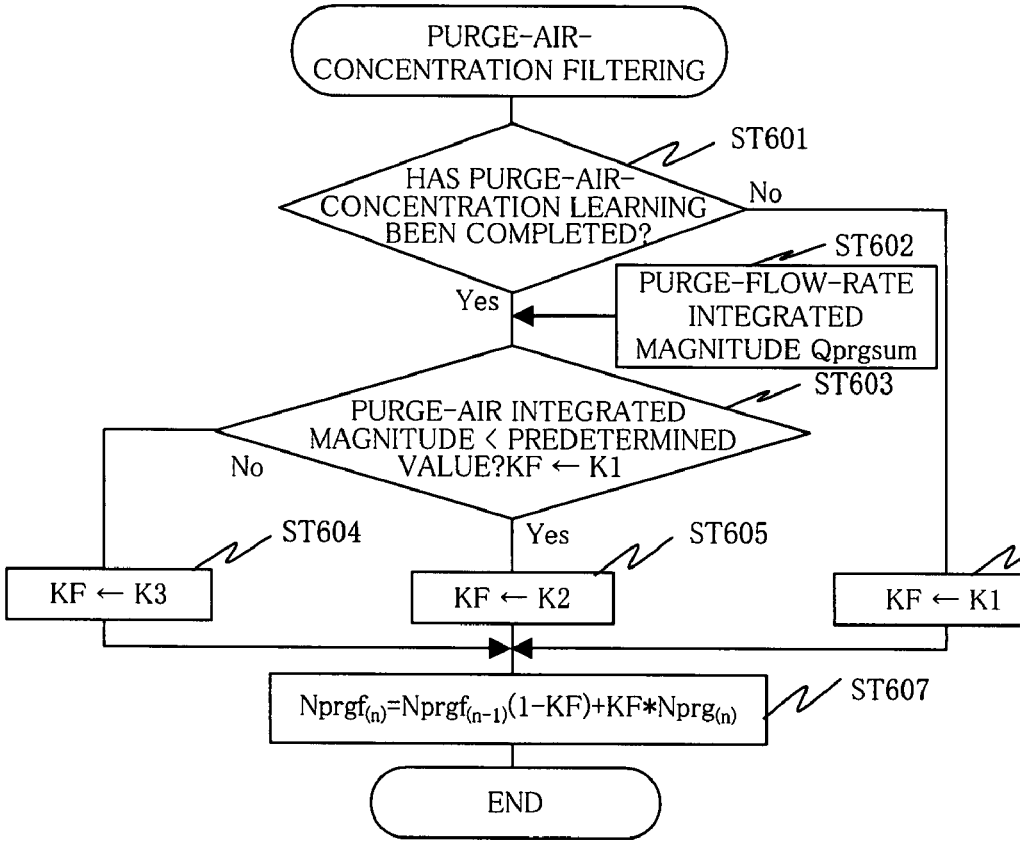
FIG. 6 is a flow chart showing an example of a purge-air-concentration filtering method in the embodiment of this invention.

FIG. 6 shows the subroutine of the operation of filtering the purge air concentration in the purge-air-concentration filtering means 206 in FIG. 2.

Referring to FIG. 6, at a step ST601, when the value of the integral term of the air/fuel ratio feedback correction coefficients since the start of the purge control becomes a median, it is judged that the purge-air-concentration learning has been completed. In case of the judgment that the purge-air-concentration learning has been completed, this subroutine proceeds to a step ST603, and in case of the judgment that the learning has not been completed, this subroutine proceeds to a step ST606.

At the step ST606, the filter constant of a purge-air-concentration filtering calculation formula to be explained later is set at a filter constant before the purge-air-concentration learning completion (K1).

At a step ST602, it is indicated that a purge-flow-rate integrated value calculated by another subroutine is employed at the step ST603.

At the step ST603, whether or not the purge-flow-rate integrated value is less than a predetermined value is judged.

In a case where, as the result of the judgment at the step ST603, the purge-flow-rate integrated value is less than the predetermined value, this subroutine proceeds to a step ST605, at which the filter constant of the purge-air-concentration filtering calculation formula to be explained later is set at a filter constant at a high purge air concentration (K2).

In a case where, as the result of the judgment at the step ST603, the purge-flow-rate integrated value is not less than the predetermined value, this subroutine proceeds to a step ST604, at which the filter constant of the purge-air-concentration filtering calculation formula to be explained later is set at a filter constant at a low purge air concentration (K3).

At a step ST607, a filtering calculation is executed by employing a first-order filter.

The application of the first-order filter to the digital computer can be generally realized by employing a digital first-order filter based on the following formula:

$$Nprgf(n)=K*Nprgf(n-1)+(1-K)*Nprg(n)$$

Here,

Nprg(n) denotes a purge air concentration before the filtering as has been calculated during the nth stroke;

Nprgf(n) denotes a purge air concentration after the filtering as has been calculated during the nth stroke;

Nprgf(n−1) denotes a purge air concentration after the filtering as has been calculated during the (n−1)th stroke; and K denotes the filter constants which have been set at the steps ST604, ST605 and ST606.

Besides, the relationship among the filter constant before the purge-air-concentration learning completion, the filter constant at the high purge air concentration, and the filter constant at the low purge air concentration is as follows:

Filter constant before Purge-air-concentration learning completion<Filter constant at High purge air concentration<Filter constant at Low purge air concentration After the start of the engine, the vaporized fuel adsorbed and stored in the active carbon within the canister remains in a large quantity, and the purge air concentration is in a thick state and is unknown, so that the exhaust gas is considered to worsen on account of the introduction of an ordinary quantity of purge air. Therefore, before the purge-air-concentration learning is completed, the purge air needs to be restrained to a comparatively small quantity. In this case, the purge air concentration gently changes in the thick state, and hence, the filtering becomes less susceptible to influences ascribable to the disturbances other than the purge air (such as the air/fuel ratio fluctuations ascribable to the acceleration or the deceleration), with the result that the errors of the purge-air-concentration calculation becomes small. Accordingly, the filter constant is set at a value (filter constant before the purge-air-concentration learning completion) which is smaller than the filter constant at the high purge air concentration and the filter constant at the low purge air concentration as will be explained later, and a filtering effect is lowered, whereby the errors ascribable to the dispersions of the airflow sensor, injector and air/fuel ratio sensor and to the air/fuel-ratio feedback control cycle can be absorbed, and the purge air concentration can be accurately calculated, so that the purge-air-concentration learning can be accurately completed.

Besides, when the ordinary quantity of purge air is introduced in accordance with the running state after the completion of the purge-concentration learning, the purge introduction is done in the state where the purge air concentration is thick. Therefore, as the purge introduction proceeds in accordance with the running state, the purge air concentration changes in the direction of thinning from the thick state while fluctuating in accordance with the purge flow rate. Accordingly, the filter constant is set at a value (filter constant at the high purge air concentration) which is larger than the constant before the purge-air-concentration learning completion, and the filtering effect is made higher than that before the purge-air-concentration learning completion, whereby while the errors ascribable to the dispersions of the airflow sensor, injector and air/fuel ratio sensor and to the air/fuel-ratio feedback control cycle are being appropriately absorbed, a purge-air-concentration learnt value which accurately reflects the fluctuations of the purge air concentration can be calculated.

Besides, about a time when the purge introduction proceeds to some extent until the purge-air integrated magnitude reaches a predetermined value, the purge air concentration becomes thin. Therefore, the purge air concentration changes gently, and the filtering becomes susceptible to the influences ascribable to the disturbances other than the purge air (such as the air/fuel ratio fluctuations ascribable to the acceleration or the deceleration), with the result that errors are liable to develop in the purge-air-concentration calculation. Accordingly, the filter constant is set at a value (filter constant at the low purge air concentration) which is larger than the constant at the high purge air concentration, and the filtering effect is made higher than at the high purge air concentration, whereby the purge-air-concentration learnt value which has appropriately absorbed the errors ascribable to the dispersions of the airflow sensor, injector and air/fuel ratio sensor and to the air/fuel-ratio feedback control cycle and the errors of the purge-air-concentration calculation attributed to the disturbances other than the purge air can be calculated.

In this manner, the purge-air-concentration filter constants are changed-over among the time before the purge-air-concentration learning completion, the case where the purge-air integrated magnitude is smaller than the predetermined value after the purge-air-concentration learning completion, and the case where the purge-air integrated magnitude is not smaller than the predetermined value after the purge-air-concentration learning completion. Thus, the purge-air-concentration learning can be accurately completed, and simultaneously, during the purge introduction after the purge-air-concentration learning completion, an accurate purge-air-concentration learning can be executed in accordance with the changing situation of the purge air concentration, with the result that the air/fuel ratio which is introduced into the internal combustion engine can be precisely controlled to the target air/fuel ratio.

Besides, in the embodiment, in the case where the purge introduction has proceeded to some extent until the purge-air integrated magnitude becomes equal to or larger than the predetermined value, the purge-air-concentration filter value is changed-over from the filter constant at the high purge air concentration, to the filter constant at the low purge air concentration. However, the purge-air-concentration filter value may well be changed-over from the filter constant at the high purge air concentration, to the filter constant at the low purge air concentration, in a case where the change magnitude of the purge-air integrated magnitude has become smaller than a predetermined value.

Figure 7:
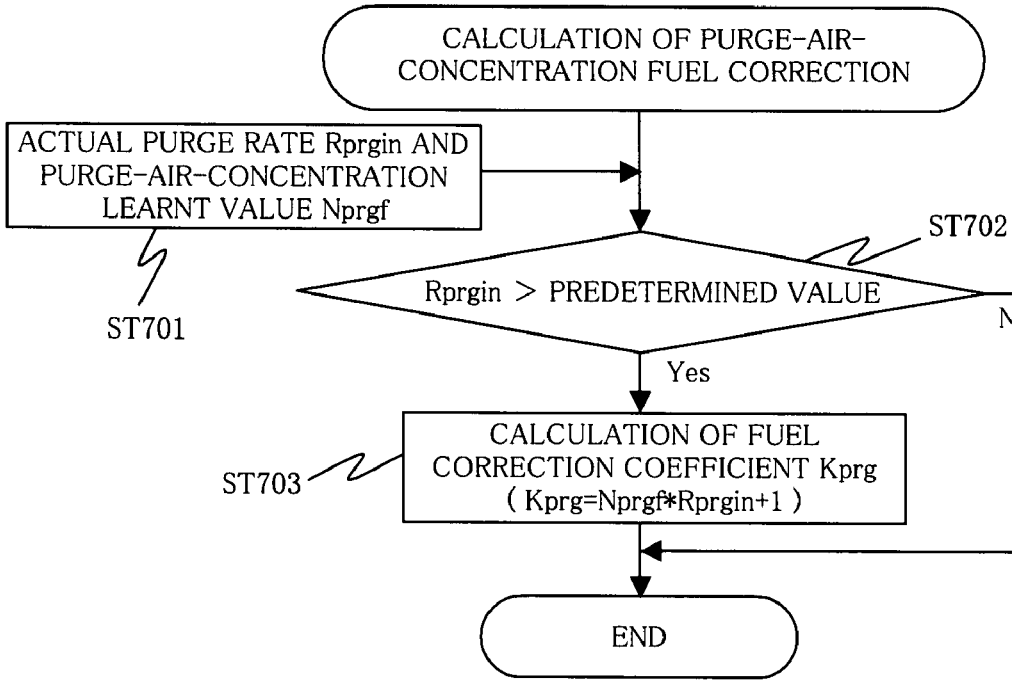
FIG. 7 is a flow chart showing a calculated example of a purge-air-concentration correction coefficient in the embodiment of this invention.

FIG. 7 shows the subroutine of the operation of calculating the purge-air-concentration fuel correction coefficient in the purge-air-concentration fuel-correction-coefficient calculation means 207 in FIG. 2.

Referring to FIG. 7, a step ST701 indicates that the actual purge rate Rprgin and the purge-air-concentration learnt value Nprgf which have been calculated by the other subroutines are employed at a step ST702.

At the step ST702, whether or not the actual purge rate Rprgin is greater than a predetermined value is judged.

Here, in a case where the actual purge rate Rprgin is greater than the predetermined value, this subroutine proceeds to a step ST703, and in a case where it is not greater, this subroutine is ended. At the step ST703, the purge-air-concentration fuel correction coefficient Kprg is calculated.

The operation of the vaporized-fuel processing device which is controlled in this manner will be described in conjunction with a timing chart shown in FIG. 8.

Figure 8:
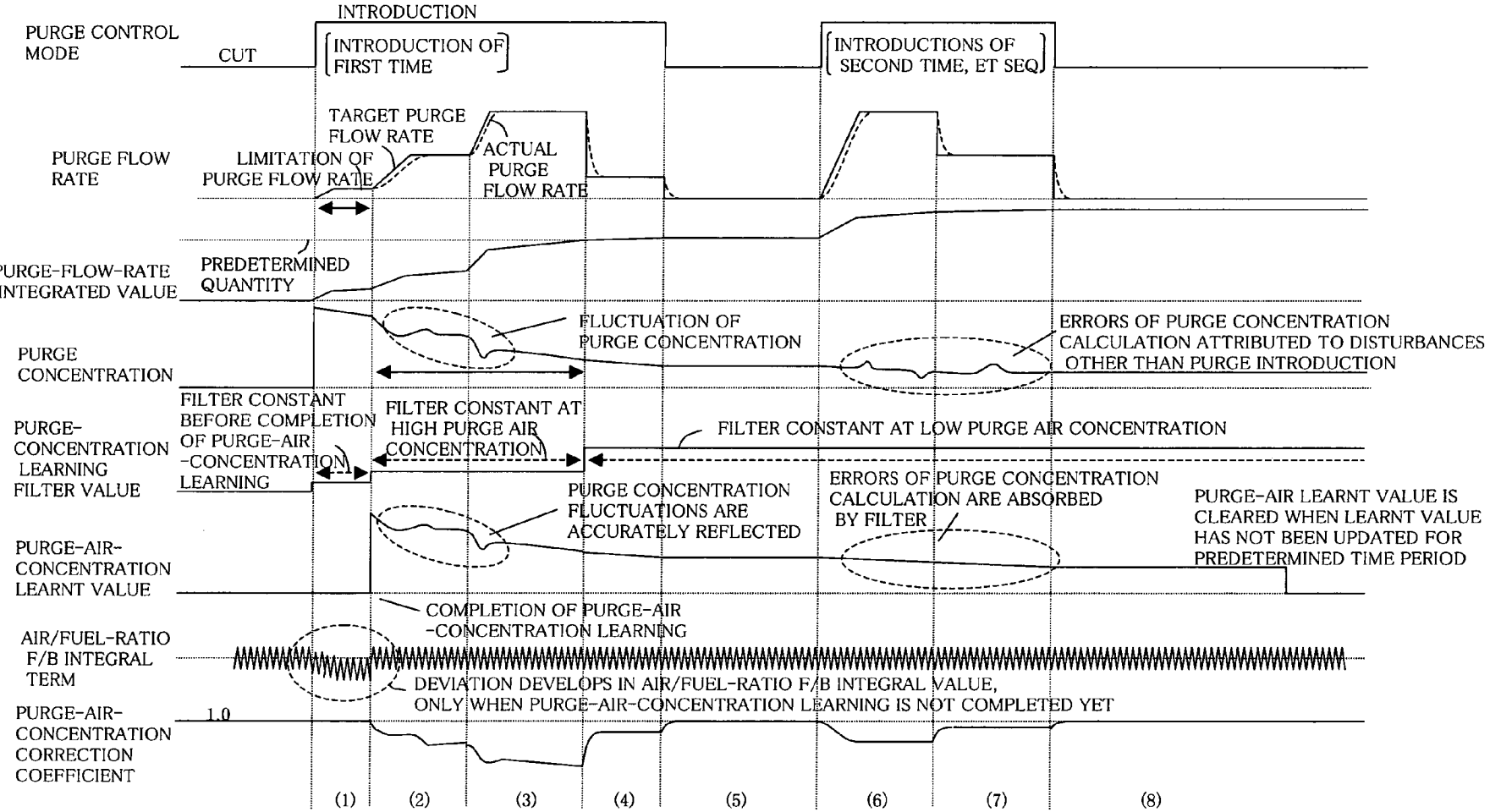
FIG. 8 is a timing chart showing an operation in the embodiment of this invention.
Figure 9:
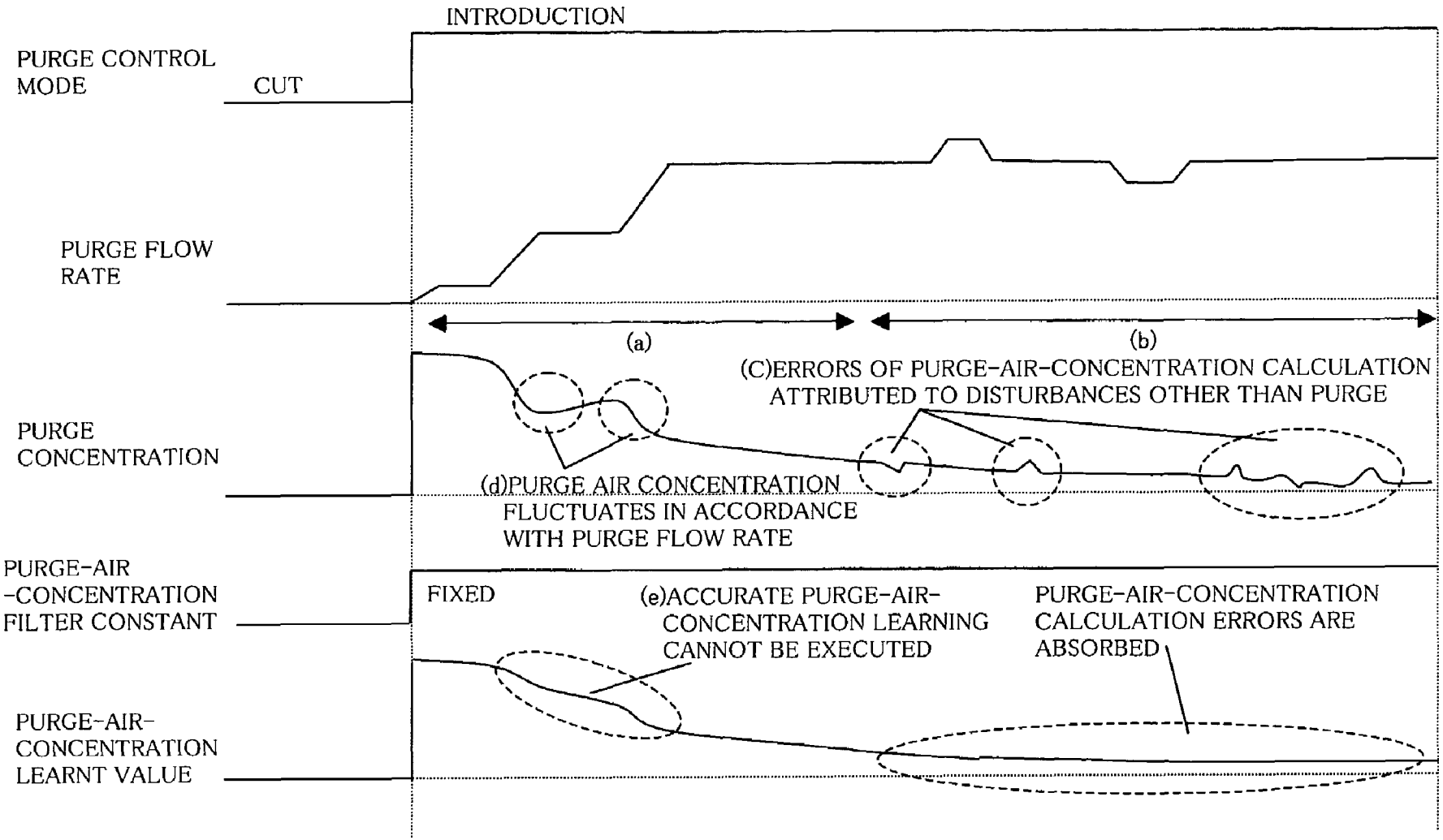
FIG. 9 is a diagram for explaining problems in purge-air-concentration learning in prior-art control apparatuses for an internal combustion engine.

FIG. 8 is the timing chart schematically representing behaviors in the case where the introduction of purge air has been done under certain running conditions, and where a purge flow rate has changed in accordance with the changes of the running conditions.

In the figure, a purge control mode part indicates the condition of the introduction or cut of the purge air, and the purge air is introduced only while the introduction condition holds true.

A purge flow rate part schematically represents the behaviors of a target purge flow rate and an actual purge flow rate during the purge air introduction.

A purge-flow-rate integrated value part schematically represents that the integrated value of the purge flow rates increases in accordance with the changes of the purge flow rates.

A purge air concentration part schematically represents that, when purge-air-concentration learning is completed, the target purge flow rate enlarges, so the purge air concentration decreases while fluctuating in accordance with the fluctuation of the target purge flow rate. Besides, it schematically represents that, when the purge introduction proceeds to some extent, the purge air concentration thins to make the change thereof small, but that the purge air concentration becomes susceptible to the influences of disturbances other than the purge introduction, so the errors of a purge-air-concentration calculation enlarge.

A purge-air-concentration learnt value part schematically represents that, after the completion of the purge-air-concentration learning, a purge-air-concentration learnt value changes in accordance with the purge air concentration.

An air/fuel ratio F/B integral term part schematically represents that, during a time period after the introduction of the purge air is allowed and before the purge-concentration learning is completed, a deviation develops in an air/fuel-ratio F/B integral term.

A purge-air-concentration correction coefficient part schematically represents the behavior of a purge-air-concentration correction coefficient.

The operation will be concretely described in temporal order.

When the purge control is started at a timing indicated by (1), the purge air quantity increases gradually. Here, if the purge-air-concentration learning is not completed yet, the purge air quantity is limited by a predetermined value, and hence, the purge concentration decreases gently. Meantime, a deviation magnitude develops in the integral term of the air/fuel-ratio feedback correction coefficient, and the purge air concentration is calculated from the deviation magnitude and an Ex purge rate. The calculated purge air concentration is subjected to filtering which employs a filter constant before the completion of the purge-air-concentration learning, whereby a purge-air-concentration learnt value is calculated. When the deviation magnitude of the integral term of the air/fuel-ratio feedback correction coefficient has become null, it is indicated that the purge-air-concentration learning is completed.

At a timing indicated by (2)-(3), the learning of the purge air concentration is completed, and the filter constant is altered from the filter constant before the purge-air-concentration learning completion, to the filter constant at the high purge air concentration.

Besides, the limitation of the purge air quantity is released, and an ordinary quantity of purge air is introduced in accordance with a running state, whereby the purge air concentration decreases while fluctuating from a thick state into a thin state in accordance with the fluctuation of the target purge flow rate, but an accurate purge-air-concentration learning corresponding to the fluctuation of the purge air concentration can be executed.

Further, after the purge-air-concentration learning completion, the integral value of the air/fuel-ratio feedback correction coefficient returns to a median, and the purge-air-concentration correction coefficient is calculated from the actual purge rate and the purge-air-concentration learnt value.

At a timing indicated by (4), the purge-flow-rate integrated value reaches a predetermined magnitude, and hence, the filter constant is altered from the filter constant at the high purge air concentration, to the filter constant at the low purge air concentration. Besides, as the purge introduction proceeds, the purge air concentration thins, and the change thereof becomes small.

Subsequently, at a timing indicated by (5), it is indicated that the purge air is cut, and that the purge-air-concentration learnt value is held stored even during the cut of the purge air.

At a timing indicated by (6) and (7), the purge air is introduced again. Since the purge concentration is thin as stated above, the purge-concentration calculation errors attributed to disturbances other than the purge introduction (such as air/fuel ratio fluctuations at an acceleration and a deceleration) become large, but a purge-air-concentration learning in which the purge-air-concentration calculation errors are absorbed to the utmost can be executed.

Besides, here at the timing of (6) and (7), unlike at the timing of (1), the purge flow rate is not limited by the predetermined value, but the control is performed with the target purge flow rate since the start of the introduction. This is because the purge-air-concentration learning has already been completed, so the control can be performed using the learnt value of the learning.

At a timing indicated by (8), at the point of time at which a predetermined time period has lapsed since the cut of the purge air, the purge-air-concentration learnt value is cleared, thereby to prevent a situation where the concentration of vaporized fuel in the canister has changed during the purge cut, to incur an error between the actual purge air concentration and the stored purge-air-concentration learnt value, and where an error develops in the purge-air-concentration correction coefficient at the re-introduction of the purge air.

In the embodiment of this invention, as stated before, the first feature consists in a control apparatus for an internal combustion engine, wherein a fuel injection quantity calculated by fuel-injection-quantity calculation means 208 is corrected with a purge-air-concentration learnt value calculated by subjecting a purge air concentration to purge-air-concentration filtering, and wherein fuel in the corrected fuel injection quantity is injected from an injector; comprising means for changing a filtering effect in the purge-air-concentration filtering, in a direction of enhancing exhaust gas purification, between in a case where the purge air concentration is thick and in a case where it is thin. Accordingly, in the control apparatus for the internal combustion engine, wherein the fuel injection quantity calculated by the fuel-injection-quantity calculation means 208 is corrected with the purge-air-concentration learnt value calculated by subjecting the purge air concentration to the purge-air-concentration filtering, and wherein the fuel in the corrected fuel injection quantity is injected from the injector; an appropriate air/fuel ratio is established even when the purge air concentration has changed depending upon a running state, and the exhaust gas purification is enhanced.

As stated before, the second feature of the embodiment of this invention consists in a control apparatus for an internal combustion engine as has the first feature, wherein the filtering effect in the case where the purge air concentration is thin is made greater than the filtering effect in the case where the purge air concentration is thick. Accordingly, even in a case where the purge air concentration is thin and changes gently, it is less susceptible to disturbances other than purge air. Consequently, even in the case where the purge air concentration is thin and changes gently, an appropriate air/fuel ratio is established, and the exhaust gas purification is enhanced.

As stated before, the third feature of the embodiment of this invention consists in a control apparatus for an internal combustion engine as has the first feature, wherein the filtering effect in the case where an integrated value of purge air quantities is large is made greater than the filtering effect in the case where the integrated value is small. Accordingly, even in a state where the purge air concentration is thinner and changes more gently than immediately after the start of purge, upon lapse of a predetermined time period since the start of the purge, it is less susceptible to disturbances other than purge air. Consequently, even in the case where the purge air concentration is thin and changes gently, an appropriate air/fuel ratio is established, and the exhaust gas purification is enhanced.

As stated before, the fourth feature of the embodiment of this invention consists in a control apparatus for an internal combustion engine, including running-state detection means 15 for detecting a running state of the internal combustion engine, purge-air-quantity control means for controlling a quantity in which vaporized fuel from a fuel tank is introduced into a suction system of the internal combustion engine, on the basis of a detection output of the running-state detection means, purge-air-quantity calculation means for calculating a purge air quantity which is introduced into the suction system of the internal combustion engine by the purge-air-quantity control means, purge-air-integrated-quantity calculation means ST404 for integrating the purge air quantities calculated by the purge-air-quantity calculation means, thereby to calculate a purge-air integrated quantity, an air/fuel ratio sensor 15 which detects an air/fuel ratio of a mixture fed into the internal combustion engine, air/fuel-ratio control means for controlling an air/fuel-ratio feedback correction coefficient which makes a correction on the basis of a detection output of the air/fuel ratio sensor so that the air/fuel ratio of the mixture to be fed into the internal combustion engine may become a target value, purge-air-concentration calculation means 205 for calculating a purge air concentration from the running state detected by the running-state detection means, the purge air quantity, and the air/fuel-ratio feedback correction coefficient, and purge-air-concentration-learnt-value calculation means 206 for subjecting the purge air concentration to purge-air-concentration filtering, thereby to calculate a purge-air-concentration learnt value, wherein the air/fuel ratio is corrected on the basis of the purge-air-concentration learnt value calculated by the purge-air-concentration-learnt-value calculation means; comprising means for setting a filter constant for use in the purge-air-concentration filtering, at a filter constant at a high purge air concentration, in a case where the purge-air integrated quantity is smaller than a predetermined value, and for setting the filter constant at a filter constant at a low purge air concentration, in a case where the purge-air integrated quantity is not smaller than the predetermined value. Thus, after the completion of purge-air-concentration learning, the purge-air-concentration filter constants are changed-over between in the case where the purge-air integrated quantity is smaller than the predetermined value and in the case where the purge-air integrated quantity is not smaller than the predetermined value. Therefore, after the completion of the purge-air-concentration learning, the purge-air-concentration learning can be accurately updated in accordance with the changing situation of the purge air concentration.

As stated before, the fifth feature of the embodiment of this invention consists in a control apparatus for an internal combustion engine as has the fourth feature, comprising purge-air-concentration-learning-completion decision means ST601 for deciding completion of the purge-air-concentration learning on the basis of the air/fuel-ratio feedback correction coefficient, wherein the filter constant for use in the purge-air-concentration filtering is set at a constant before the purge-air-concentration learning completion, before the completion of the purge-air-concentration learning, and thereafter, when the purge-air integrated quantity is smaller than the predetermined value, the filter constant is set at the filter constant at the high purge air concentration, and when the purge-air integrated quantity is not smaller than the predetermined value, the filter constant is set at the filter constant at the low purge air concentration. Thus, the purge-air-concentration filter constants are changed-over among the time before the purge-air-concentration learning completion, the case where the purge-air integrated quantity is smaller than the predetermined value after the purge-air-concentration learning completion, and the case where the purge-air integrated quantity is not smaller than the predetermined value after the purge-air-concentration learning completion. Therefore, the purge-air-concentration learning can be accurately completed, and after the purge-air-concentration learning completion, the purge-air-concentration learning can be accurately updated in accordance with the changing situation of the purge air concentration.

While the presently preferred embodiment of this invention has been shown and described, it is to be understood that these disclosures are for the purpose of illustration and that various changes and modifications may be made without departing from the scope of the invention as set forth in the appended claims.

What is claimed is:

1. A control apparatus for an internal combustion engine, comprising:

a fuel-injection-quantity calculation means for calculating a fuel injection quantity;

wherein the fuel injection quantity is corrected with a purge-air-concentration learnt value calculated by subjecting a purge air concentration to purge-air-concentration filtering, and wherein fuel in the corrected fuel injection quantity is injected from an injector;

the control apparatus further comprising means for changing a filtering effect in the purge-air-concentration filtering, in a direction of enhancing exhaust gas purification, between when the purge air concentration is thick and when the purge air concentration is thin.

2. A control apparatus for an internal combustion engine as defined in claim 1, wherein the filtering effect when the purge air concentration is thin is greater than the filtering effect when the purge air concentration is thick.

3. A control apparatus for an internal combustion engine as defined in claim 1, wherein the filtering effect when an integrated value of purge air quantities is large is greater than the filtering effect when the integrated value is small.

4. A control apparatus for an internal combustion engine, comprising:

running-state detection means for detecting a running state of the internal combustion engine, purge-air-quantity control means for controlling a quantity in which vaporized fuel from a fuel tank is introduced into a suction system of the internal combustion engine, on the basis of the detection output of the running-state detection means, purge-air-quantity calculation means for calculating a purge air quantity which is introduced into the suction system of the internal combustion engine by the purge-air-quantity control means, purge-air-integrated-quantity calculation means for integrating the purge air quantities calculated by the purge-air-quantity calculation means, to calculate a purge-air integrated quantity, an air/fuel ratio sensor which detects an air/fuel ratio of a mixture fed into the internal combustion engine, air/fuel-ratio control means for controlling an air/fuel-ratio feedback correction coefficient which makes a correction on the basis of a detection output of the air/fuel ratio sensor so that the air/fuel ratio of the mixture to be fed into the internal combustion engine becomes a target value, purge-air-concentration calculation means for calculating a purge air concentration from the running state detected by the running-state detection means, the purge air quantity, and the air/fuel-ratio feedback correction coefficient, and purge-air-concentration-learnt-value calculation means for subjecting the purge air concentration to purge-air-concentration filtering, to calculate a purge-air-concentration learnt value, wherein the air/fuel ratio is corrected on the basis of the purge-air-concentration learnt value calculated by the purge-air-concentration-learnt-value calculation means;

the control apparatus further comprising means for setting a filter constant for use in the purge-air-concentration filtering, the filter constant set at a high purge air concentration when the purge-air integrated quantity is smaller than a predetermined value, and the filter constant set at a low purge air concentrations when the purge-air integrated quantity is not smaller than the predetermined value.

5. A control apparatus for an internal combustion engine as defined in claim 4, further comprising purge-air-concentration-learning-completion decision means for deciding completion of the purge-air-concentration calculation on the basis of the air/fuel-ratio feedback correction coefficient, wherein the filter constant for use in the purge-air-concentration filtering is set at a constant before the purge-air-concentration calculation completion, and thereafter, wherein, when the purge-air integrated quantity is smaller than the predetermined value, the filter constant is set at the filter constant at the high purge air concentration, and wherein, when the purge-air integrated quantity is not smaller than the predetermined value, the filter constant is set at the filter constant at the low purge air concentration.

6. A control apparatus for an internal combustion engine, comprising:

purge-air-quantity control means for controlling a quantity in which vaporized fuel from a fuel tank is introduced into a suction system of the internal combustion engine;

purge-air-quantity calculation means for calculating a purge air quantity which is introduced into the suction system of the internal combustion engine by the purge-air-quantity control means;

purge-air-integrated-quantity calculation means for integrating the purge air quantities calculated by the purge-air-quantity calculation means to calculate a purge-air integrated quantity;

purge-air-concentration calculation means for calculating a purge air concentration;

purge-air-concentration-learnt-value calculation means for subjecting the purge air concentration to purge-air-concentration filtering to calculate a purge-air-concentration learnt value; and means for setting a filter constant for use in the purge-air-concentration filtering, the filter constant set at a high purge air concentration when the purge-air integrated quantity is smaller than a predetermined value, and the filter constant set at a low purge air concentration when the purge-air integrated quantity is not smaller than the predetermined value.

* * * * *